United States Patent [19]

Zunkel

[11] Patent Number: 4,903,765

[45] Date of Patent: Feb. 27, 1990

[54] DELAYED OPENING FLUID SAMPLER

[75] Inventor: Gary D. Zunkel, Chickasha, Okla.

[73] Assignee: Halliburton Company, Duncan, Okla.

[21] Appl. No.: 294,323

[22] Filed: Jan. 6, 1989

[51] Int. Cl.[4] ..... E21B 49/08

[52] U.S. Cl. ..... 166/162; 166/64; 166/169; 166/264; 73/864.62; 73/864.64

[58] Field of Search ..... 166/169, 163, 165, 264, 166/162; 175/59, 233; 73/863.71, 863.72, 864.62, 864.63, 864.64

[56] References Cited

U.S. PATENT DOCUMENTS

| | | | |
|---|---|---|---|
| 2,557,925 | 6/1951 | Stokes | 166/264 X |
| 2,862,561 | 12/1958 | Teubner | 166/264 X |
| 3,095,930 | 7/1963 | Kisling, III | 166/264 X |
| 4,372,382 | 2/1983 | Rooney et al. | 166/26 X |
| 4,502,537 | 3/1985 | Carter, Jr. | 166/162 |
| 4,665,983 | 5/1987 | Ringgenberg | 166/250 |
| 4,766,955 | 8/1988 | Petermann | 166/167 |
| 4,787,447 | 11/1988 | Christensen | 166/169 |

*Primary Examiner*—Stephen J. Novosad
*Attorney, Agent, or Firm*—E. Harrison Gilbert, III

[57] ABSTRACT

A delayed opening fluid sampling tool comprises a body having three chambers and a port defined therein. The tool also comprises a metering device which is disposed in the body between two of the chambers, one of which chambers is for holding a metering fluid and the other of which is for receiving fluid which is transferred through the metering device. The tool further comprises a valve which is disposed in the body between the port and the remaining chamber, which remaining chamber is for receiving a well fluid sample. The valve is moved relative to the body in response to pressure acting on the valve through the port. Only after a predetermined time delay after the pressure begins moving the valve is the valve positioned to communicate the port with the sample-receiving chamber.

20 Claims, 3 Drawing Sheets

DELAYED OPENING FLUID SAMPLER

BACKGROUND OF THE INVENTION

This invention relates generally to a fluid sampling tool which, in response to pressure, opens to collect a fluid sample. The invention more particularly, but not by way of limitation, relates to a downhole well fluid sampling apparatus for use in a well, which apparatus does not open until a time delay after a pressure starts moving a valve of the apparatus.

In the oil and gas industry one from time to time needs to obtain one or more samples of fluid from a well bore. See U.S. Pat. No. 4,787,447 to Christensen, U.S. Pat. No. 4,766,955 to Petermann, U.S. Pat. No. 4,665,983 to Ringgenberg and U.S. Pat. No. 4,502,537 to Carter, Jr.

In general, to obtain a sample, a fluid sampling tool is first lowered, such as on a tubing string or a wireline or a slickline, into the well. When the tool is at the desired depth, a port (one or more openings) defined in the tool is opened, such as in response to pressure exerted through the well fluid or in response to an electrical actuation from the surface. The open port admits well fluid into a sample retaining chamber within the tool. The port is thereafter closed, the tool is withdrawn from the well, and the sample is taken from the chamber for analysis.

The fluid which one typically wants to analyze is fluid from a subterranean formation or reservoir intersected by the well so that it can be determined whether the fluid is suitable for being produced. It sometimes happens, however, that there is also drilling mud or other fluid in the well bore at or near the location where the well fluid sample is to be obtained. This latter, typically undesired (from a sampling standpoint) fluid can be the first fluid to be received by a fluid sampling tool, and it can be in sufficient quantity to fill the sample retaining chamber of the tool before any of the desired fluid can be stored. This produces an unwanted sample and slows or prevents the completion of the sampling process because one or more additional trips in and out of the well are needed to obtain a proper sample, if one can be obtained at all. This is, of course, costly. Therefore, there is the need for an improved fluid sampling tool which enhances the chances of obtaining a proper sample each time a sample is taken.

There is also a shortcoming with respect to the type of fluid sampling tool which uses shear pins to hold a valve adjacent the sampling port closed until a pressure in the well exceeds the holding force of the pins. Operation of such a tool at a desired depth requires that the holding force of the pins and the downhole pressure be accurately determined so that the two can be correlated to allow the tool to open at the desired depth. Making such an accurate determination of the holding force of specific pins and pressures at downhole locations can be difficult. Thus, there is also the need for an improved fluid sampling tool which has a reduced dependency on accurate pressure readings and shear pins.

SUMMARY OF THE INVENTION

The present invention overcomes the above-noted and other shortcomings of the prior art by providing a novel and improved fluid sampling tool. The present invention is constructed to have a time delay which starts when a valve of the tool first starts to move in response to pressure from the well (or other environment). At least in some usages, this time delay allows undesired fluid to bypass the tool before the valve communicates a port with a sample chamber and a sample of the fluid in the well (or other environment) is taken. This time delay can also reduce the dependency on accurate pressure readings and shear pins. For example, when a maximum bottomhole pressure is measured or otherwise anticipated, shear pins providing a holding force of something less than this maximum pressure, but one which will clearly be encountered somewhere downhole despite a lack of assurance as to precisely where it will be, can be used so that the pins will break at some location above the bottom of the well; the time delay, designed with a suitable tolerance to assure reaching bottom before its expiration, is then used to allow the tool to be run on down to the well bottom, where it will ultimately automatically open.

Other advantages of the present invention include: simplicity of design, fabrication and operation; suitability for use in wells or other environments where pressure exists to actuate the tool, such as in a sample chamber of a perforate/test sampler tool; adaptability for being run into a well on a tubing string, wireline or slickline or otherwise because no electrical or pressure signals from the surface need to be used to operate the tool (the tool, however, is not excluded from such use); and utilization with or without shear pins or other holding mechanism depending upon the nature of the specific use to which the present invention is put.

The present invention provides a fluid sampling tool which comprises: a body having a first chamber, a second chamber, a third chamber and a port defined therein; means, disposed in the body between the second and third chambers, for impeding fluid flow from the second chamber to the third chamber; and valve means, disposed in the body between the port and the first chamber for being moved relative to the body in response to pressure acting on the valve means through the port, for communicating the port with the first chamber only after a predetermined time delay after the pressure begins moving the valve means. In a preferred embodiment, the tool further comprises means for holding, with a holding force, the valve means relative to the port until pressure from the well communicated through the port exceeds the holding force. A preferred embodiment of the tool also comprises a movable member disposed in the first chamber.

The valve means of a preferred embodiment of the tool includes: first closure means for maintaining the port sealed from the first chamber as the valve means moves relative to the port during the predetermined time delay; open means, connected to the first closure means, for providing a fluid conducting passageway between the port and first chamber after the predetermined time delay; and second closure means, connected to the open means, for sealing the port from the first chamber after the open means has moved past the port.

Therefore, from the foregoing, it is a general object of the present invention to provide a novel and improved fluid sampling tool. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

Figure 1:
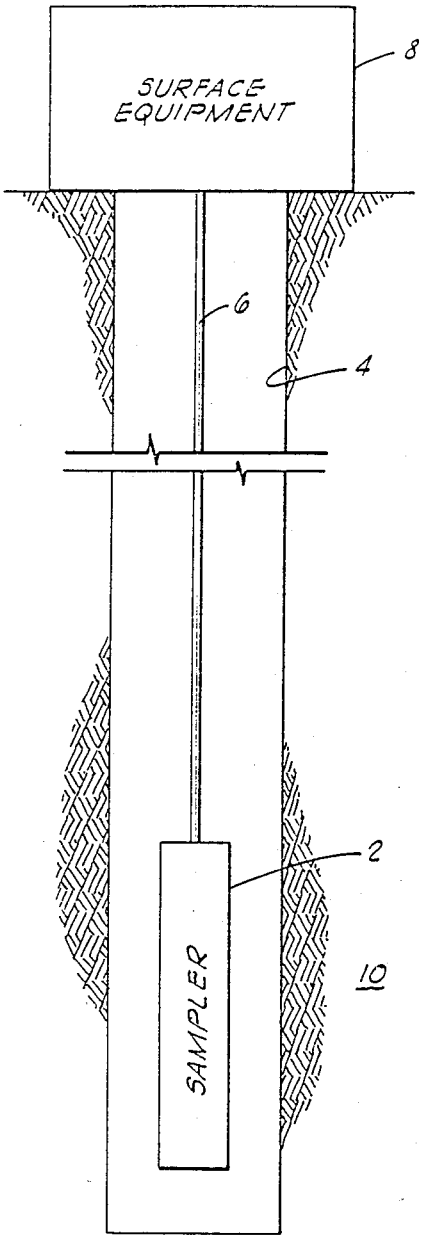
FIG. 1 is a schematic and block diagram depicting an environment in which the preferred embodiment of the present invention is particularly adapted for use.

A fluid sampling tool 2, representing the present invention, is shown in FIG. 1 disposed in an oil or gas well defined by a bore 4 which is typically lined with casing (not shown). The tool 2 is lowered and raised relative to the bore 4 on a slickline 6 which is manipulated by conventional surface equipment 8. The present invention can be used with other types of equipment, such as with a tubing string, or on a wireline, or below a packer as would be readily apparent to those skilled in the art. For the environment depicted in FIG. 1, the tool 2 operates in response to hydrostatic pressure exerted by fluid in the bore 4, which is depicted as intersecting a formation 10.

Another particular environment in which the present invention can be used is in a large sample chamber of a perforate/test sampler tool. This would place the present invention in an atmospheric chamber into which fluid is flowed. In the oil and gas context, such a flow of fluid might first contain a quantity of drilling mud followed by the well fluid from the formation 10 which is to be sampled.

The structure of the preferred embodiment of the fluid sampling tool 2 of the present invention will be described with reference to FIGS. 2A–2C, after which the operation of the preferred embodiment will be described with reference to FIGS. 1–4.

Figure 2A:
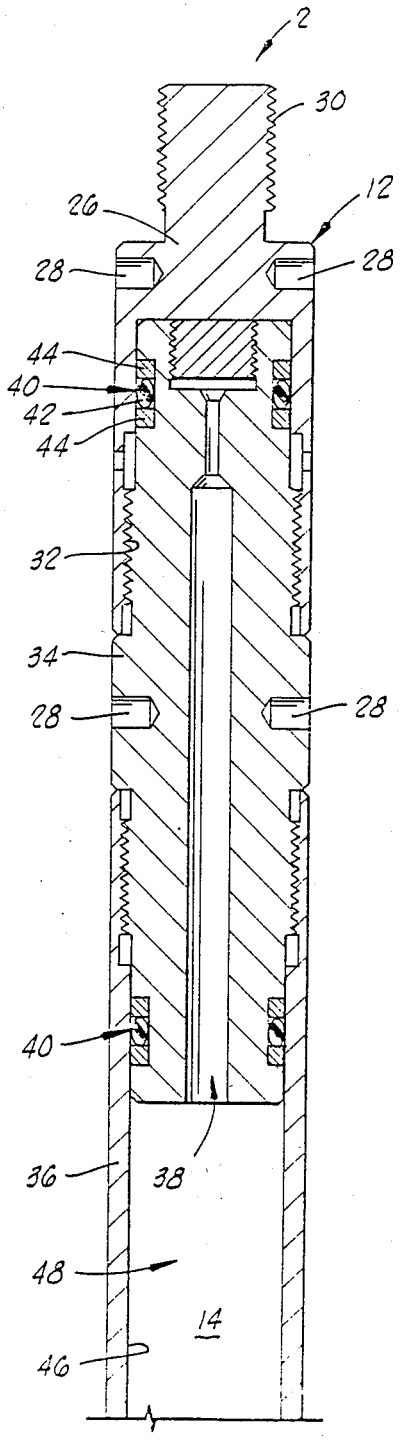
FIGS. 2A–2C form a longitudinal sectional view of a preferred embodiment of the fluid sampling tool of the present invention, wherein a valve of the tool is in an initial closed position.
Figure 2B:
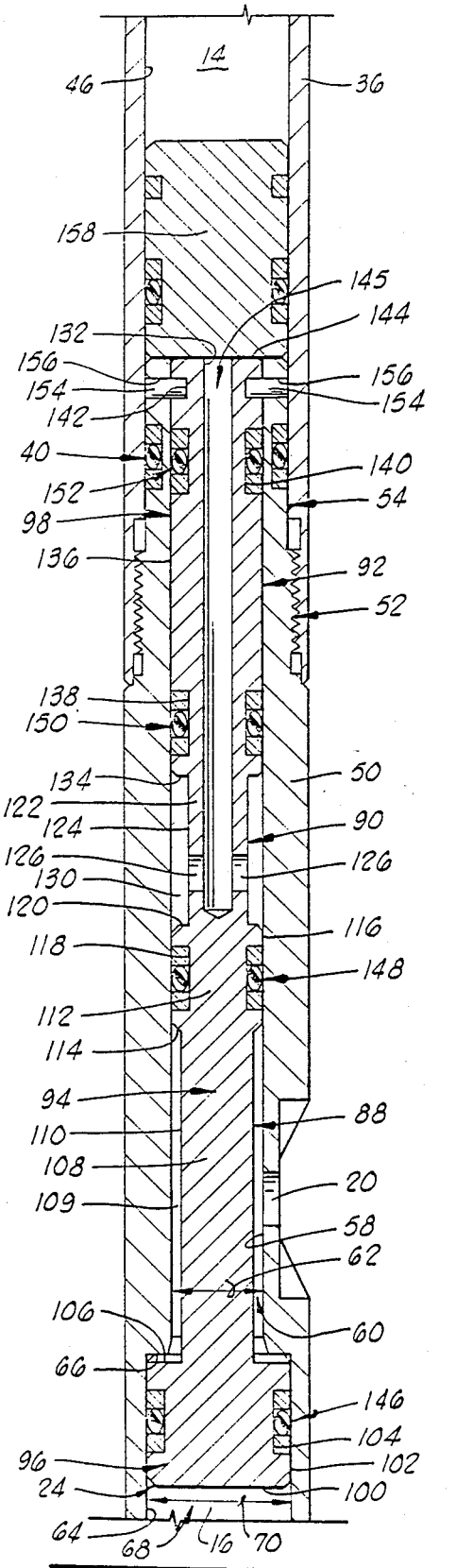
Figure 2C:
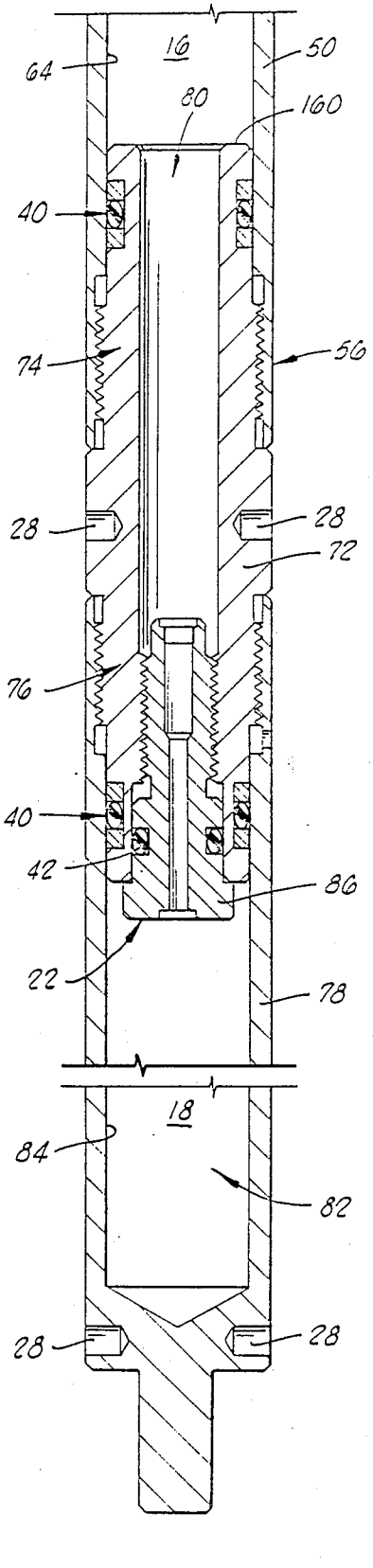

The preferred embodiment of the fluid sampling tool 2 of the present invention, as shown in FIGS. 2A–2C, includes an elongated body 12 with three chambers 14, 16, 18 and a port 20 (comprising one or more holes through the side wall of the body 12) defined therein. The tool 2 further comprises means 22, disposed in the body 12 between the chambers 16, 18 as shown in FIG. 2C, for impeding fluid flow from the chamber 16 to the chamber 18. The preferred embodiment of the tool 2 also includes valve means 24, disposed as shown in FIG. 2B in the body 12 between the port 20 and the chamber 14 for being moved relative to the body 12 in response to pressure acting on the valve means 24 through the port 20, for communicating the port 20 with the chamber 14 only after a predetermined time delay after the pressure begins moving the valve means 24.

Beginning at the top of the orientation in FIG. 2A, the body 12 includes at one end an end coupling member 26 which defines either the top or the bottom of the tool 2. That is, the tool 2 depicted in FIGS. 2A–2C can be used in either vertical orientation such that the end coupling member is at either the top or bottom of such orientation. The end coupling member 26 has a plurality of bores 28 defined in its body for receiving a spanner wrench by which the member 26 can be rotated for coupling and uncoupling to or from threaded connections. One such threaded connection is made at an end 30 to the slickline 6 when the tool 2 is used in the embodiment depicted in FIG. 1. Another such threaded connection is made at an interior threaded surface 32 of the member 26. This connects the member 26 to an end coupling adapter 34 forming another part of the body 12.

As illustrated in FIG. 2A, the end coupling adapter 34 has two threaded pin ends, including the one connected to the end coupling member 26 and another connected to a housing 36 of the body 12. The end coupling adapter 34 also includes a plurality of the bores 28 for receiving a spanner wrench. Axial bores define a longitudinal passageway 38 through the end coupling adapter 34. Seal means 40, including an O-ring 42 and backup elements 44, are mounted in respective grooves at the two ends of the end coupling adapter 34.

The housing 36 which is connected to the end coupling adapter 34 and shown in FIGS. 2A–2B is a cylindrical sleeve having an interior surface 46 which defines a cavity 48 that is at least part of the chamber 14. The chamber 14 of which the cavity 48 forms at least a part is particularly a sample chamber for receiving a fluid sample, such as from the well defined by the bore 4 depicted in FIG. 1. As will be more particularly defined hereinbelow, the sample is received through the port 20 which is defined through the wall of a housing 50 which is connected at one end to the housing 36 opposite the end coupling adapter 34. This connection is by mating threaded surfaces forming a joint 52 shown in FIG. 2B. This joint is sealed by another seal means 40.

The housing 50, shown in FIGS. 2B and 2C, is a cylindrical sleeve having a pin end 54 used in forming the joint 52 and also having a threaded box end 56 opposite the end 54. The housing 50 includes an interior surface 58 defining a cavity 60 which communicates with the cavity 48 of the housing 36 and thus can also define part of the sample chamber 14. The cavity 60 has a cross-sectional area indicated by the line 62 in FIG. 2B. In the preferred embodiment this cross-sectional area is circular and has a diameter commensurate with the line 62. The port 20, which can include more than the one opening shown in FIG. 2B, intersects the surface 58 and communicates the environment exterior of the tool 2 with the cavity 60 so that the port 20 provides an opening in the tool 2 through which pressure and fluid from the well can pass.

The housing 50 includes an interior surface 64 extending longitudinally from and spaced radially outwardly from the interior surface 58 by a radial or transverse surface 66 shown in FIG. 2B. The surface 64 defines a cavity 68 which is coaxial with the cavity 60 and which has a cross-sectional area identified by the line 70 in FIG. 2B. The cross-sectional area 70 of the preferred embodiment is circular so that the line 70 also represents a diameter of the cavity 68. As is apparent from FIG. 2B, the cross-sectional area of the cavity 68 is greater than the cross-sectional area of the cavity 60. The cavity 68 defines at least part of the chamber 16 which in the preferred embodiment is a metering fluid reservoir chamber for receiving a metering fluid, specifically a liquid such as oil of a conventional type as is known to those skilled in the art.

Referring to FIG. 2C, connected to the box end 56 of the housing 50 is an adapter member 72 having a threaded pin end 74 connected to the housing 50 and carrying a seal means 40. The adapter member 72 also has a pin end 76 which carries another seal means 40 and is connected to a housing 78. The adapter member 72 and the housing 78 form additional parts of the body 12 of the preferred embodiment of the present invention.

The adapter member 72 has an axial passageway 80 defined therethrough. This passageway 80 communicates with the cavity 68 of the housing 50 and thus forms another part of the chamber 16 wherein metering fluid is held. Upon operation of the present invention as subsequently described, such metering fluid, or at least a portion thereof, is forced through the passageway 80 and the means 22 retained in the end 76 of the adapter member 72 as shown in FIG. 2C. Upon passing through the means 22, such metering fluid is received in the chamber 18 defined by a cavity 82 formed by an interior surface 84 of the housing 78. The chamber 18 defined by the cavity 82 is, in the preferred embodiment, a metering fluid receptacle chamber for receiving metering fluid transferred from the metering fluid reservoir chamber 16.

The adapter member 72 and the housing 78 also include pluralities of the bores 28 for receiving a spanner wrench.

Still referring to FIG. 2C, the means 22 for impeding fluid flow from the chamber 16 to the chamber 18 is defined in the preferred embodiment by a conventional metering device such as a metering cartridge 86 containing a metering orifice means such as a Visco-Jet element of a type as known to the art. This orifice means prevents fluid flow from the chamber 16 to the chamber 18 until the metering fluid contained in the chamber 16 is placed under sufficient pressure, which occurs when the valve means 24 is pushed by a sufficient pressure acting through the port 20 as will be more fully described hereinbelow. In the preferred embodiment shown in FIG. 2C, the metering cartridge 86 is threadedly connected into the passageway 80 at the end 76 of the adapter member 72, and the metering cartridge 86 carries one of the sealing O-rings 42.

Figure 3:
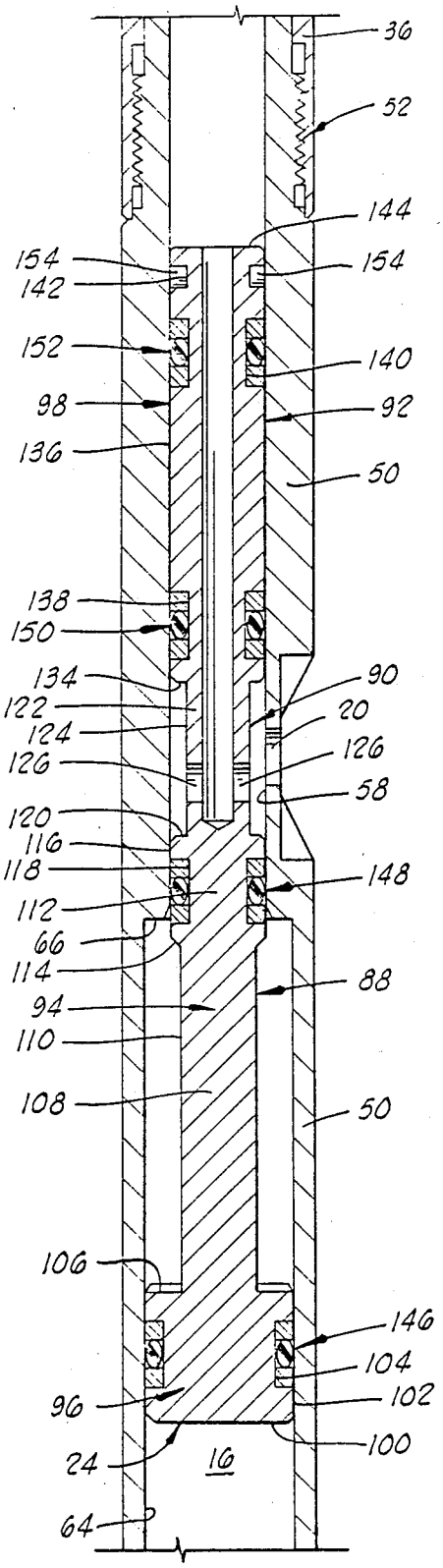
FIG. 3 is a longitudinal sectional view of a portion of the embodiment shown in FIGS. 2A–2C with the valve shown moved to its open, sample-receiving position.
Figure 4:
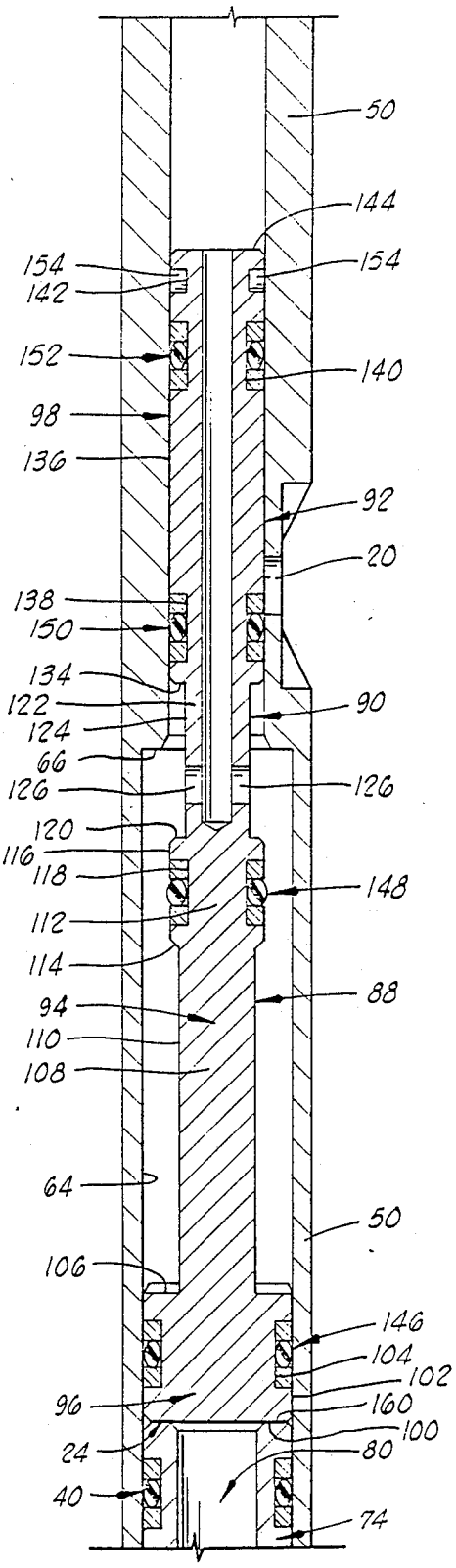
FIG. 4 is a longitudinal sectional view of a portion of the embodiment shown in FIGS. 2A–2C with the valve in a subsequent closed position.

Referring to FIG. 2B, the preferred embodiment of the valve means 24 will be described. As shown in FIG. 2B, the valve means 24 has parts disposed in both the cavity 60 and the cavity 68 of the housing 50. In general, the valve means 24 has three sections referred to herein as first closure means 88, open means 90 and second closure means 92. The first closure means 88 is for maintaining the port 20 sealed from the chamber 14 as the valve means 24 moves relative to the port 20 during the predetermined time delay. The open means, integrally connected to and extending longitudinally from the first closure means 88, is for providing a fluid conducting passageway between the port 20 and the chamber 14 after the predetermined time delay. The second closure means 92, integrally connected to and extending longitudinally from the open means 90, is for sealing the port 20 from the chamber 14 after the open means 90 has moved past the port 20. With these three sections, the valve means 24 is movable through at least a portion of the chamber 16 in response to pressure from the well communicated through the port 20. As the valve means 24 moves, it pushes metering fluid from the chamber 16, through the metering means 22, and into the chamber 18. When this initially occurs during a first time from the time the valve means 24 starts to move and push metering fluid, the valve means 24, by the first closure means 88, seals the port 20 from the chamber 14 for preventing well fluid from entering the chamber 14. Thereafter, during a second time, the valve means 24, by the open means 90, communicates the port 20 with the chamber 14 for allowing a sample of well fluid to be received in the chamber 14. Further thereafter, during a third time, the valve means 24, by the second closure means 92, seals the port 20 from the chamber 14 for holding the sample of well fluid in the chamber 14. A position of the valve means 24 during the aforementioned first time is illustrated in FIG. 2B, a position of the valve means 24 during the aforementioned second time is illustrated in FIG. 3, and a position of the valve means 24 during the aforementioned third time is illustrated in FIG. 4.

Referring again to FIG. 2B, the particular structure of the illustrated preferred embodiment of the valve means 24 will be described. The preferred embodiment valve means 24 is a member which includes an elongated valve body 94. The body 94 has an end 96 disposed in the cavity 68, and the body 94 has an end 98 disposed in the cavity 60. The end 96 has a cross-sectional area substantially the same as the cross-sectional area 70, and the end 98 has a cross-sectional area substantially the same as the cross-sectional area 62 ("substantially the same as" means equal to but for tolerances or other design differences whereby the valve means 24 is slidable within the cavities 60, 68).

The end 96 of the valve body 94 is identified as a head portion which in the preferred embodiment has a circular cross section with a diameter substantially the same as the diameter also represented by the arrow 70. This head portion includes a circular end surface 100 which is disposed transverse to the elongated body 12 of the tool 2. The head portion also includes a cylindrical outer surface 102 which extends longitudinally from the end surface 100. A circumferential groove 104 is defined in the surface 102. The head portion terminates at an annular intermediate transverse surface 106 which extends inwardly from the outer surface 102.

Extending from the head portion of the valve body 94 is a neck portion 108 which has a diameter smaller than the diameter of the head portion. It is also smaller than the diameter represented by the arrow 62 shown in FIG. 2B so that an annulus 109 exists between the neck portion 108 and housing 50. The neck portion 108 includes a cylindrical outer surface 110 which extends longitudinally from the transverse surface 106. The length of the surface 110, and thus of the neck portion 108, is one of the factors to be considered in determining the particular time delay to be implemented in a specific valve. Another factor to be considered is the rate of metering through the means 22. Thus, the predetermined time delay implemented by the present invention is so predetermined by the metering rate and the length of the neck portion 108.

Extending from the neck portion 108 is a shoulder portion 112 of the valve body 94. The shoulder portion 112 has a cross-sectional area and a diameter smaller than those of the head portion at the end 96 but larger than those of the neck portion 108. The cross-sectional area and the diameter of the shoulder portion 112 are substantially the same as these features identified by the reference numeral 62. The shoulder portion 112 includes a transverse surface 114 which extends outwardly from the outer surface 110. The shoulder portion 112 also includes a cylindrical outer surface 116 which extends longitudinally from the transverse surface 114. A circumferential groove 118 is defined in the surface 116. The shoulder portion 112 terminates at an intermediate transverse surface 120 which extends inwardly from the outer surface 116.

An intermediate portion 122 of the valve body 94 extends from the shoulder portion 112. The intermediate portion 122 includes a cylindrical outer surface 124 which extends longitudinally from the transverse surface 120. A plurality of radial apertures 126 intersect the outer surface 124 and an interior surface 128. The diameter of the intermediate portion 122 is smaller than the diameter 62 so that an annulus 130 is defined between the interior surface 58 of the housing 50 and the outer surface 124 of the intermediate portion 122.

Extending longitudinally from the intermediate portion 122 is the end portion 98 of the valve body 94. The surface 128 of the intermediate portion 122 extends on through the end portion 98 to an opening 132 which communicates with the chamber 14. The end portion 98 also includes a transverse surface 134 which extends outwardly from the outer surface 124 of the intermediate portion 122. The end portion 98 also includes a cylindrical outer surface 136 which extends longitudinally from the transverse surface 134. Three circumferential grooves 138, 140, 142 are defined in the surface 136. The end portion 98 has a cross-sectional area and diameter substantially the same as those indicated by the reference numeral 62. The end portion 98 terminates at an annular end surface 144 which extends inwardly from the outer surface 136. The apertures 126, the interior surface 128 and the opening 132 define a passageway 145 from the intermediate portion 122 through the end portion 98.

The valve means 24 also includes four seal means. A seal means 146 is disposed in the groove 104 of the head portion at the end 96. This provides a seal between the head portion and the interior surface 64 of the body 12. A seal means 148 is disposed in the groove 118 of the shoulder portion 112 to provide a seal between the shoulder portion 112 and the interior surface 58 of the body 12. A seal means 150 is disposed in the groove 138 of the end portion 98 to provide a seal between the end portion and the interior surface 58 of the body 12. The seal means 152 is disposed in the groove 140 of the end portion 98 to provide a seal between the end portion 98 and the interior surface 58 of the body 12. Each of the seal means 146, 148, 150, 152 includes an O-ring (not separately numbered) in sealing contact with the adjacent surface and two backup elements (not separately numbered) of types as are known in the art.

In the preferred embodiment shown in FIGS. 2A–2C, the tool 2 further comprises means for holding, with a holding force, the valve means 24 relative to the port 20 until pressure from the well communicated through the port 20 exceeds the holding force. This means is implemented in the preferred embodiment by frangible shear pins 154 (FIG. 2B) retained in holes 156 defined in the end 54 of the housing 50. The inner ends of the shear pins 154 are inserted into the circumferential groove 142 in the end portion 98 of the valve body 94. The shear pins 154 hold the valve body 94 stationary relative to the outer body 12 of the tool 2 and the port 20 thereof until pressure above a predetermined magnitude acts on the surfaces 106, 114 of the valve body 94. This produces a differential force which is the difference between the pressure from the well exerted on the area of the surface 106 and pressure from the well exerted on the area of the surface 114. Because the area of the surface 106 is greater, the pressure force differential, when large enough, moves the valve body 94 downwardly as viewed in FIG. 2B. The pressure force differential must exceed the holding force determined by the number and nature of the shear pins 154 before the valve body 94 begins its movement from the position illustrated in FIG. 2B.

It is to be noted that the shear pins shown in FIG. 2B are needed when the tool 2 is used in an environment such as the one illustrated in FIG. 1. No shear pins or other equivalent holding means are needed when the tool 2 is used in an environment such as the sample chamber of a perforate/test sampler tool.

The preferred embodiment of the tool 2 shown in FIGS. 2A–2C still further comprises a movable member 158 (FIG. 2B) disposed in the chamber 14 (specifically the cavity 48 thereof) so that the movable member 158 moves therein in response to the chamber 14 receiving well fluid through the internal passageway 145 of the valve means 24. The moveable member 158 is specifically referred to as a piston which is free to move through the cavity 48 between the housing 50 and the end coupling adapter 34.

Although the foregoing description of the tool 2 has made particular reference to various elements thereof having cylindrical or circular shapes, the present invention is not limited to any such specific shape or construction.

OPERATION

To describe the operation of the preferred embodiment shown in FIGS. 2A–2C, reference will be made to the environment illustrated in FIG. 1. That is, it will be assumed that the tool 2 is to take a sample at the bottom of the well defined by the bore 4. It will be assumed that the hydrostatic pressure at such bottom location is believed to be 4000 pounds per square inch (psi); however, to avoid having to know how accurate the 4000 psi value is, the present invention in the embodiment shown in FIGS. 2A–2C would be used. One or more shear pins 154 would be selected to give a sufficient holding force of some value less than 4000 psi which assuredly exists in the well bore even given the difficulty of knowing the accuracy of the 4000 psi value or precisely where in the bore such lesser pressure exists. For example, 3600 psi might be selected. Thus, the present invention reduces the dependency on knowing precisely what and where well bore pressures are and tolerances of shear pins.

To prepare the tool 2, metering fluid of a suitable known type is put in the chamber 16. One way to do this would be to remove the housing 78 and the metering cartridge 86 and pour the fluid through the passageway 80 of the adapter member 72. After this, the cartridge 86 would be installed and the housing 78 connected to the adapter member 72. Alternatively, a side fill hole (not shown) could be provided through the side wall of the housing 50 in communication with the chamber 16.

With the shear pins 154 in place, the metering fluid put in the chamber 16, and the tool 2 assembled as shown in FIGS. 2A–2C, the tool 2 is lowered into the well with the conventional surface equipment 8. Since no electrical signals need to be transferred between the surface and the tool 2, this lowering can be on a slickline, for example.

As the tool 2 is being run in the hole or bore 4, the hydrostatic pressure from the fluid within the bore 4 acts on the valve body 94 between the areas identified by the reference numerals 70 and 62. More specifically, the pressure acts on the area of the surface 106 and the area of the surface 114 through the one or more holes of the sample port 20. When the pressure differential applied to these surfaces is sufficient to overcome the holding force of the pins 154, the pins 154 shear or break and the piston-like valve body 94 begins to move downwardly as viewed in FIG. 2B. The valve body 94 is prevented from instantly moving its entire travel by the metering means 22. But movement of the valve body 94 does begin as the metering fluid in the chamber 16 begins to meter through the metering means 22 into the receptacle chamber 18 which is typically an atmospheric air chamber.

After the time delay effected by the metering of the means 22 and the length of the neck portion 108 of the valve means 24, and the seal means 148 passes the sample port 20 whereby well fluid flows through the sample port 20 into the annulus 130 and on through the passageway 145 defined through the intermediate portion 122 and the end portion 98 of the valve body 94 (see FIG. 3). As the well bore fluid enters the chamber 14, pressure remains exerted on the valve body 94 to continue its downward movement while also pushing the piston 158 upward as viewed in FIG. 2B.

After a further time period during which the intermediate portion 122 of the valve body 94 travels past the sample port 20, the seal means 150 passes the sample port 20 so that the seal means 150, 152 prevent further actuating pressure differentials from acting on the valve body 94. This also prevents further fluid flow into the chamber 14. This position of the valve body 94 is illustrated in FIG. 4 wherein the end surface 100 of the valve body 44 is shown abutting an end surface 160 of the adapter member 72. With the valve body 94 in this position, the tool 2 can be retrieved to the surface and the collected sample drained and analyzed.

One technique for draining the sample from the chamber 14 is to remove the housing 78 and the metering cartridge 86 and then to insert a rod (not shown) to shift the valve body 94 back to its open position (see FIG. 3) whereby the fluid in the sample chamber 14 can drain through the passageway 145 in the valve body 94 and the sample port 20. The sample chamber 14 can also be purged by pumping fluid through the passageway 38 of the end coupling adapter 34 and against the piston 158 to drive the piston 158 back toward the housing 50.

Thus, when the tool 2 is run on a slickline as just described, the shear pins 154 allow the tool 2 to be run in nearly to the bottom of the well before the tool 2 starts to operate. Once the pins 154 are sheared, the tool 2 does not open instantly but is delayed, allowing the tool 2 to be run all the way to the bottom prior to collecting a sample. This reduces the dependency on accurate pressure readings and shear pins.

When the tool 2 is used in a sample chamber of a perforate/test sampler tool, for example, the shear pins 154 need not be used. The delay of the metering system would be sufficient to delay the sampler from opening instantly. This would allow unwanted drilling fluid to bypass the port 20 before it is opened to collect the desired reservoir fluid typically trailing the drilling fluid.

A variety of metering devices and metering fluids and shear pins or other holding mechanisms (when needed) can be used to allow the tool 2 to operate at different pressures and with different time delays. Specific designs can be readily made by those skilled in the art. Thus, while a preferred embodiment of the invention has been described for the purpose of this disclosure, changes in the construction and arrangement of parts can be made by those skilled in the art, which changes are encompassed within the spirit of this invention as defined by the appended claims.

What is claimed is:

1. A fluid sampling tool, comprising:

a body having a first chamber, a second chamber, a third chamber and a port defined therein;

means, disposed in said body between said second and third chambers, for impeding fluid flow from said second chamber to said third chamber; and valve means, disposed in said body between said port and said first chamber for being moved relative to said body in response to pressure acting on said valve means through said port, for communicating said port with said first chamber only after a predetermined time delay after said pressure begins moving said valve means.

2. A tool as defined in claim 1, further comprising frangible means for holding said valve means stationary relative to said body until pressure above a predetermined magnitude acts on said valve means through said port.

3. A tool as defined in claim 1, wherein said valve means includes:

first closure means for maintaining said port sealed from said first chamber as said valve means moves relative to said port during said predetermined time delay;

open means, connected to said first closure means, for providing a fluid conducting passageway between said port and first chamber after said predetermined time delay; and second closure means, connected to said open means, for sealing said port from said first chamber after said open means has moved past said port.

4. A tool as defined in claim 1, wherein said valve means includes:

an elongated valve body having a first end disposed adjacent said second chamber and having a second end disposed adjacent said first chamber;

a first seal disposed on said valve body at said first end;

a second seal disposed on said valve body intermediate said first and second ends;

a third seal disposed on said valve body intermediate said first and second ends and spaced from said second seal;

a fourth seal disposed on said valve body at said second end; and wherein said valve body includes a passageway defined therein between said second end and a location in between said second and third seals.

5. A tool as defined in claim 1, wherein said body includes:

an end coupling member;

an end coupling adapter connected to said end coupling member;

a first housing having a first cavity for defining at least part of said first chamber, said first housing connected to said end coupling adapter;

a second housing having a second cavity and a third cavity wherein said third cavity defines at least a portion of said second chamber, said second housing connected to said first housing so that said second cavity communicates with said first cavity, and said second housing having said port defined therein in communication with said second cavity, and wherein said valve means is disposed in said second and third cavities;

an adapter member connected to said second housing, said adapter member having said means for impeding fluid flow retained therein; and a third housing connected to said adapter member and having a fourth cavity defining said third chamber.

6. A tool as defined in claim 5, wherein:

said second housing includes a first interior surface defining said second cavity with a first cross-sectional area and said second housing includes a second interior surface defining said third cavity with a second cross-sectional area greater than said first cross-sectional area;

said port intersects said first interior surface; and said valve means includes:

an elongated valve body having a first end disposed in said third cavity and having a second end disposed in said second cavity, said first end having a cross-sectional area substantially the same as said second cross-sectional area and said second end having a cross-sectional area substantially the same as said first cross-sectional area;

a first seal disposed on said valve body at said first end and in sealing contact with said second interior surface;

a second seal disposed on said valve body intermediate said first and second ends;

a third seal disposed on said valve body intermediate said first and second ends and spaced from said second seal and in sealing contact with said first interior surface;

a fourth seal disposed on said valve body at said second end and in sealing contact with said first interior surface; and wherein said valve body includes a passageway defined therein between said second end and a location in between said second and third seals.

7. A tool as defined in claim 6, further comprising a piston disposed in said first cavity.

8. A tool as defined in claim 5, wherein:

said second housing has a hole defined therein; and said tool further comprises a shear pin disposed in said hole in engagement with said valve means.

9. A downhole well fluid sampling apparatus for use in a well, said apparatus comprising:

elongated means for defining a sample chamber for receiving a fluid sample from the well, a metering fluid reservoir chamber for receiving a metering fluid, a metering fluid receptacle chamber for receiving a transfer of metering fluid from said metering fluid reservoir chamber and a port for providing an opening in said apparatus through which pressure and fluid from the well can pass;

metering means, disposed in said elongated means, for metering fluid flow from said metering fluid reservoir chamber to said metering fluid receptacle chamber; and valve means, disposed in said elongated means and movable through at least a portion of said metering fluid reservoir chamber in response to pressure from the well communicated through said port, for pushing at least a portion of the metering fluid from said metering fluid reservoir chamber, through said metering means, into said metering fluid receptacle chamber so that during a first time from the time said valve means starts to move and push metering fluid said valve means seals said port from said sample chamber for preventing well fluid from entering said sample chamber, and thereafter during a second time said valve means communicates said port with said sample chamber for allowing a sample of well fluid to be received in said sample chamber, and thereafter during a third time said valve means seals said port from said sample chamber for holding the sample of well fluid in said sample chamber.

10. An apparatus as defined in claim 9, further comprising means for holding, with a holding force, said valve means relative to said port until pressure from the well communicated through said port exceeds said holding force.

11. An apparatus as defined in claim 9, wherein said valve means includes:

a first end surface, disposed transverse to said elongated means;

a first outer surface, extending longitudinally from said first end surface and having a groove defined therein;

a first intermediate transverse surface, extending inwardly from said first outer surface;

a second outer surface, extending longitudinally from said first intermediate transverse surface;

a second intermediate transverse surface, extending outwardly from said second outer surface;

a third outer surface, extending longitudinally from said second intermediate transverse surface and having a groove defined therein;

a third intermediate transverse surface, extending inwardly from said third outer surface;

a fourth outer surface, extending longitudinally from said third intermediate transverse surface;

a fourth intermediate transverse surface, extending outwardly from said fourth outer surface;

a fifth outer surface, extending longitudinally from said fourth intermediate transverse surface and having two grooves defined therein;

a second end surface, extending inwardly from said fifth outer surface;

an interior surface extending from said second end surface to said fourth outer surface for defining a passageway therebetween;

first seal means disposed in said groove of said first outer surface;

second seal means disposed in said groove of said third outer surface;

third seal means disposed in one of said two grooves of said fifth outer surface; and fourth seal means disposed in the other of said two grooves of said fifth outer surface.

12. An apparatus as defined in claim 11, wherein said fifth outer surface has a third groove for receiving a shear pin.

13. An apparatus as defined in claim 11, further comprising a movable member disposed in said sample chamber so that said movable member moves therein in response to said sample chamber receiving well fluid through said passageway of said valve means.

14. An apparatus as defined in claim 9, further comprising a movable member disposed in said sample chamber.

15. An apparatus as defined in claim 9, wherein said elongated means includes:

an end coupling member;

an end coupling adapter connected to said end coupling member;

a first housing having a first cavity for defining at least part of said sample chamber, said first housing connected to said end coupling adapter;

a second housing having a second cavity and a third cavity wherein said third cavity defines at least part of said metering fluid reservoir chamber, said second housing connected to said first housing so that said second cavity communicates with said first cavity, and said second housing having said port defined therein in communication with said second cavity, and wherein said valve means is disposed in said second and third cavities;

a third housing having a fourth cavity defining said metering fluid receptacle chamber; and an adapter member retaining said metering means and connecting said second and third housings.

16. An apparatus as defined in claim 15, wherein:

said second housing includes a first interior surface defining said second cavity with a first cross-sectional area and said second housing includes a second interior surface defining said third cavity with a second cross-sectional area greater than said first cross-sectional area;

said port intersects said first interior surface; and said valve means includes:

an elongated valve body having a first end disposed in said third cavity and having a second end disposed in said second cavity, said first end having a cross-sectional area substantially the same as said second cross-sectional area and said second end having a cross-sectional area substantially the same as said first cross-sectional area;

a first seal disposed on said valve body at said first end and in sealing contact with said second interior surface;

a second seal disposed on said valve body intermediate said first and second ends;

a third seal disposed on said valve body intermediate said first and second ends and spaced from said second seal and in sealing contact with said first interior surface;

a fourth seal disposed on said valve body at said second end and in sealing contact with said first interior surface; and wherein said valve body includes a passageway defined therein between said second end and a location in between said second and third seals.

17. An apparatus as defined in claim 16, further comprising a piston disposed in said first cavity.

18. An apparatus as defined in claim 15, wherein:

said second housing has a hole defined therein; and said apparatus further comprises a shear pin disposed in said hole in engagement with said valve means.

19. A downhole well fluid sampling apparatus for use in a well, said apparatus comprising:

an elongated body having a sample chamber, a liquid chamber, an air chamber and a port;

a metering member retained in said body between said liquid chamber and said air chamber; and a valve member disposed in said body adjacent said port, said valve member including:

a head portion having a first diameter, said head portion disposed for movement in said liquid chamber;

a neck portion extending from said head portion and having a second diameter smaller than said first diameter;

a shoulder portion extending from said neck portion and having a third diameter smaller than said first diameter but larger than said second diameter;

an intermediate portion extending from said shoulder portion;

an end portion extending from said intermediate portion and having a passageway extending therethrough and into said intermediate portion;

first seal means for providing a seal between said head portion and said body;

second seal means for providing a seal between said shoulder portion and said body;

third seal means for providing a first seal between said end portion and said body; and fourth seal means, spaced from said third seal means, for providing a second seal between said end portion and said body.

20. An apparatus as defined in claim 19, further comprising means for holding, with a predetermined holding force, said valve member relative to said port until a differential force acting on said valve member exceeds said predetermined holding force, said differential force being the difference between pressure from the well exerted on an area of said head portion defined between said first and second diameters and pressure from the well exerted on an area of said shoulder portion defined between said second and third diameters.

* * * * *